US010040176B2

(12) United States Patent
Williams et al.

(10) Patent No.: US 10,040,176 B2
(45) Date of Patent: Aug. 7, 2018

(54) EXTENDED IMPACT SOCKET CONSTRUCTION

(71) Applicant: Lisle Corporation, Clarinda, IA (US)

(72) Inventors: Danny Williams, Clarinda, IA (US); Christopher Watson, Liberty, SC (US)

(73) Assignee: LISLE CORPORATION, Clarinda, IA (US)

( * ) Notice: Subject to any disclaimer, the term of this patent is extended or adjusted under 35 U.S.C. 154(b) by 263 days.

(21) Appl. No.: 15/013,736

(22) Filed: Feb. 2, 2016

(65) Prior Publication Data

US 2016/0221159 A1 Aug. 4, 2016

Related U.S. Application Data

(60) Provisional application No. 62/111,992, filed on Feb. 4, 2015.

(51) Int. Cl.

| | |
|---|---|
| ***B25B 13/06*** | (2006.01) |
| ***B25B 21/02*** | (2006.01) |
| ***B25B 27/00*** | (2006.01) |

(52) U.S. Cl.

CPC ..... *B25B 13/065* (2013.01); *B25B 21/02* (2013.01)

(58) Field of Classification Search

CPC ..... B25B 13/06; B25B 13/065; B25B 13/48; B25B 13/481; B25B 21/02

See application file for complete search history.

(56) References Cited

U.S. PATENT DOCUMENTS

| | | | | |
|---|---|---|---|---|
| 6,997,085 | B2 * | 2/2006 | Yamamoto | B25B 13/06 411/402 |
| 7,841,261 | B2 * | 11/2010 | Milligan | B25B 13/06 81/121.1 |
| 9,463,557 | B2 * | 10/2016 | Seith | B25B 23/0035 |
| 9,469,017 | B2 * | 10/2016 | Seith | B25B 13/06 |
| 2014/0260825 | A1 * | 9/2014 | Milligan | B25B 13/06 81/124.6 |
| 2016/0193724 | A1 * | 7/2016 | Abel | B25B 23/108 81/125 |

OTHER PUBLICATIONS

The American Society of Mechanical Engineers, Socket Wrenches, Handles, and Attachments, ASME B;107.110-2012—Jun. 7, 2013.

* cited by examiner

*Primary Examiner* — David B Thomas

(74) *Attorney, Agent, or Firm* — Banner & Witcoff, Ltd.

(57) ABSTRACT

An elongated, generally, cylindrical impact socket has a driven end, a drive end. The socket is elongated, the cylindrical shape parsed in at least two, distinct uniform diameter generally coaxial sections having a mass in the range of at least about 2 to 3 times the mass of a standard or extended ASME B107.110-2012 socket.

9 Claims, 2 Drawing Sheets

EXTENDED IMPACT SOCKET CONSTRUCTION

CROSS REFERENCE TO RELATED APPLICATION

This is a utility application based on provisional application Ser. No. 62/111,992 filed Feb. 4, 2015 entitled "Extended Impact Socket Construction" for which priority is claimed in its entirety.

BACKGROUND OF THE INVENTION

In a principal aspect the present invention relates to a socket construction of a type utilized by automotive repair mechanics and service personnel. More specifically, the invention comprises a socket construction wherein the socket has a driven end, typically with a square or spline drive cross section counterbore, and a drive end, with a hexagonal cross section counterbore for engaging a threaded fastener to either attach or remove the fastener from a compatibly threaded bore or opening. The socket may comprise an alternative to sockets Type I, II and VII as disclosed by ASME standard B107.110-2012 (incorporated herein by reference).

When repairing automobiles, machinery or other items, a mechanic or technician typically requires multiple sets and types of tools, including wrenches, for removal of or attachment of bolts, screws, nuts and other fasteners. For example, one such task involving a mechanic is attachment or removal of the harmonic balancer associated with an internal combustion engine. That is, the harmonic balancer may be attached by hexagonal headed bolts threaded into and recessed in a counterbore. The bolts thus fasten the harmonic balancer to the drive shaft of the internal combustion engine. To remove the harmonic balancer from the shaft, a hexagonal socket may be positioned on the head of a bolt and a pneumatic impact tool is then fitted on the socket and used to drive the socket and thereby unthread the fastener from the shaft to which the balancer is attached.

This is an extremely difficult undertaking and typically requires a pneumatic impact tool to drive the socket in order to provide adequate torque necessary to loosen and remove the fasteners. Because the head of a fastener is often recessed in a counterbore, access may be limited or restricted. Also, because a fastener may be corroded, very high torque may be required to effect removal of the fastener. Many motor vehicles exhibit this problem including, for example, certain models of Honda brand vehicles.

Thus, there has developed a need for tools and methods for removal of extremely tightly or highly torqued fasteners, particularly from vehicles wherein fasteners are used to attach a harmonic balancer or some other mechanical part to the vehicle or vehicle engine.

SUMMARY OF THE INVENTION

In a principal aspect the present invention comprises an elongate, high mass, impact socket comprised of a body with a cylindrical outer surface that extends between a driven end of the socket and a drive end of the socket. The driven end of the socket may comprise a square or spline cross section counterbore adapted to receive the square drive or spline drive of a pneumatic impact tool. The opposite drive end of the socket includes a hexagonal counterbore coaxial with the cylindrical body and the driven counterbore end. The dimensions, density, mass, physical character and outer surface shape of the socket construction typically comprises features of design including an elongate, high mass, socket useful in a circumstance where many prior art sockets do not function appropriately or may fracture or otherwise fail. Additionally, the disclosed socket is fabricated with a unitary design to be compatible with a high impact, pneumatic driver.

Thus, an aspect, feature, objective and benefit of the socket construction of the invention is to provide a carefully dimensioned, elongate socket construction having a relatively high density, increased mass relative to a typical socket, high tensile strength and good fracture toughness. The socket has dimensional and other requisite characteristics including weight or mass which enable the socket to provide high impact forces on a fastener to efficiently and effectively loosen a very heavily torqued and tightly attached fastener from a threaded passage or bore. The socket is uniquely useful in combination with a cooperative, pneumatic impact tool to drive the socket.

A further object of the invention is to provide a socket which has broad utility; namely, a design that will enable efficient operation in combination with a standard impact tool or wrench for removal of frozen or locked fasteners.

Another object of the invention is to provide a socket which is useful over a wide range of torque requirements for attachment as well as removal or unthreading of a fastener.

These and other aspects, objects, advantages and features of the invention are set forth in the detailed description which follows.

BRIEF DESCRIPTION OF THE DRAWING

In the detailed description which follows reference is made to the drawing comprised of the following figures.

DETAILED DESCRIPTION OF EMBODIMENTS OF THE INVENTION

Figure 1:
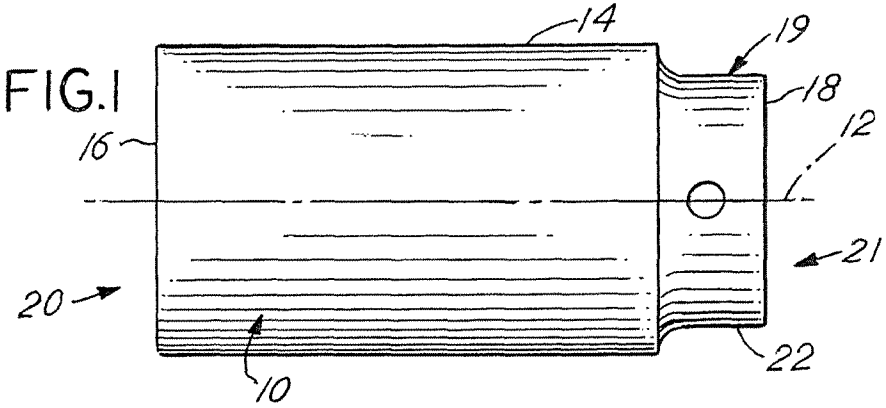
FIG. 1 is a plan view of an embodiment of the socket of the invention.
Figure 4:
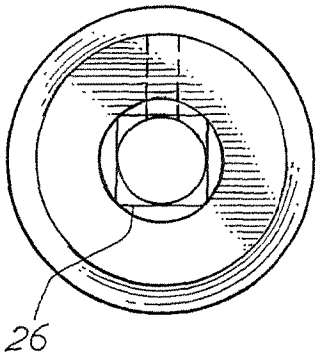
FIG. 4 is an end view of the driven end of socket of FIG. 1 as viewed from the right hand side of FIG. 1.
Figure 3:
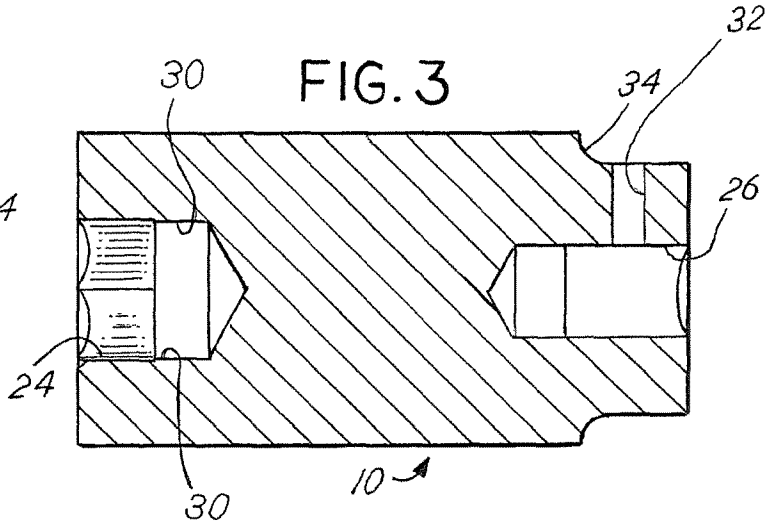
FIG. 3 is a cross sectional view of the socket of FIG. 1 taken along the line 3-3 in FIG. 2.

Sockets having an appropriate size, mass or weight and design in combination with a standard pneumatic impact wrench are disclosed. Such sockets provide a successful means to increase the effective torque imparted to a fastener and thereby enhance the efficiency and the utility of an impact tool or wrench to detach or unthread or thread a fastener from or into a threaded bore or passage. That is, typically the necessary torque or turning force required to remove a fastener from a threaded passage or bore is dependent upon the condition, size, design and configuration of the fastener and the threaded bore. The dimensional characteristics or relationship between the size of and the dimensional and design characteristics of a socket to provide adequate, useful torque and thus effect fastener removal are uniquely disclosed.

A socket embodiment of the invention is depicted in FIGS. 1-4 and comprises a cylindrical body 10 having a straight, centerline axis 12. The body 10 is comprised or includes a first uniform outside, cylindrical diameter section 14, a first end 20 with a flat planar face 16 transverse to the axis 12 at the first drive end 20. Center line axis 12 extends axially in a straight direction to a second, transverse, planar, flat face 18 at a second or driven end 21. The first cylindrical section 14 thus extends between the first transverse flat face 16 axially toward the second transverse flat face 18 in the range of about 85±4% of the axial distance from the first face 16 to the second face 18.

Figure 2:
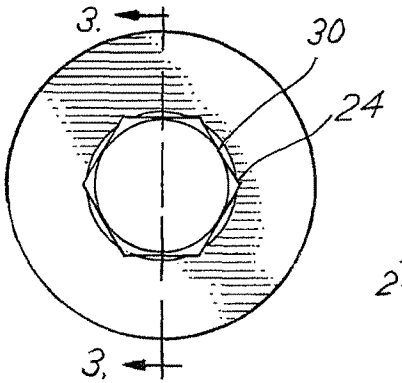
FIG. 2 is an end view of the drive end of the socket of FIG. 1 as viewed from the left hand side of FIG. 1.

A second uniform diameter, concentric, cylindrical outside section 22 of the body 10 extends axially intermediate the first section 14 and the second face 18 at end surface 21. The second section 22 has an outside diameter in the range of about 80%±5% of the outside diameter of the first section 14 which has a cylindrical cross section as depicted in FIG. 2.

The outside radius of the first section 14 is in the range of 2.25±0.2 times the point to point dimension 30 of a hexagonal counterbore 24 at the drive end axis coaxial with a square or spline counterbore 26 in the driven end of the body 10. The socket has an axial dimension in the range of about 2+0.2 to −0.1 times the axial depth dimension of the hexagonal counterbore 24. The socket further has a material density in the range of about 0.28±0.03 pounds per cubic inch and tensile strength in the range of or at least greater than about 150,000±25,000 psi. The socket further includes a transverse or radial passage 32 at the driven end 19 of the socket which is for receipt of a pin of a drive of an impact tool joined to the socket.

The first greater axially extending section 14 and the second, lesser axially extending section 22 of the socket are joined along a circumferential, arcuately curved uniform radius section 34. The square counterbore 26 has a point to point dimension in the range of 1.0±0.50 times the point to point dimension of the hexagonal counterbore 24.

Tables 1 and 2 set forth a summary of the physical parameters of a standard socket and two test sockets. Socket 1 is a prior art standard socket design. Sockets 2 and 3 are variations of the socket design embodiments of the invention wherein socket design 3 is a preferred embodiment depicted in FIGS. 1-4. Specifically the drive end depth and configuration, the driven end depth are variable, but are desirably within limitations to maintain adequate mass of the socket. The mass of the sockets is purposely within the ranges of the parameters set forth. The dimensional ranges and relationships are preferably maintained in accord with ratios of the examples set forth in the tables.

Thus, the dimension of the socket drive end is correlated with the other socket dimensions. In particular, the diameter of the threaded fastener and the head thereof serve as an initial basis for determination of and maintaining proportionality with the remaining dimensions and mass of the socket. As a consequence, upon determining the size and dimensions of a fastener diameter and fastener head, one may calculate a proportional relationship to the remaining dimensions of a socket associated with a particular fastener having a particular thread design. Importantly, the mass of the socket is correlated with fastener dimensions. Each socket can in this manner be correlated with the size of the fastener which is to be removed or engaged and driven.

Following are examples of sockets (items 2 and 3) which are designed to safely maximize dimensional limits to provide adequate torque in the environment associated with the tools and devices which require high torque to be provided by standard torque wrenches.

TABLE 1

| SOCKET | 1 (Standard Design) | 2 (Experimental Design) | 3 (Experimental Design) |
|---|---|---|---|
| Density | .28 lb/in$^3$ | .28 lb/in$^3$ | .28 lb/in$^3$ |
| Total Mass | 8 oz. | 20 oz. | 30 oz. |
| Length (inches) | 3.125 | 3.500 | 3.500 |
| Diameter (Max) (inches) | 1.100 | 1.375 | 1.690 |
| Diameter (Min) (inches) | 1.100 | 1.375 | 1.375 |
| Socket Configuration | Cylindrical | Cylindrical | Multiple Cylindrical Sections |
| Drive End Configuration | ½ inch square | ½ inch square | ½ inch square |
| Driven End Configuration | 19 MM Hex | 19 MM Hex | 19 MM Hex |
| Material | CR-MO | CR-MO | CR-MO |
| Radial Profile | Round | Round | Round |
| Longitudinal Profile | Straight | Straight | Straight with turned end |

TABLE 2

| DIMENSIONS IN INCHES | |
|---|---|
| SOCKET 3 PARAMETERS | 3 |
| Length (inches) | 3.50 ± 0.2 |
| First Section Length (14) (inches) | 2.50 ± 0.2 |
| Second Section Length (22) (inches) | 0.70 ± 0.3 |
| Intermediate Section Length (34) (inches) | .24 ± 0.03 |
| First Section Diameter (inches) | 1.70 ± 0.10 |
| Second Section Diameter (inches) | 1.375 ± 0.30 |
| Drive End Depth (inches) | 0.75 ± 0.10 |
| Driven End Depth (inches) | 1.0 ± 0.2 |
| Mass | 0.28 ± about 0.3 pounds/cubic inch |
| Fracture Toughness | 28-60 HRC |
| Tensile Strength | 150,000 ± 25,000 pounds/square inch |

The empirical data of two series of tests, as set forth in Tables 3 and 4, was obtained using test sockets 1, 2 and 3 of Table 1 and Table 2 to remove threaded fasteners in compatible threaded openings in a test block. The test block was thus threaded to receive a standard "Harmonic Balancer Bolt". A thread locker compound "Loctite 232" was applied to the bolt prior to being threaded into a test block. The "Loctite" (trade name) compound was allowed to cure after the bolt was tightened to various torque values as shown in Tables 3 and 4. The "Loctite" compound was applied to simulate the effects of corrosion and "tightness" of the fastener.

The tests to effect removal of the fasteners were conducted with a Craftsman Model No. 875-198650 air impact wrench. The wrench was operated at a static pressure of 88 psi and a dynamic pressure of 50 psi. The air impact wrench is typical of the type used by technicians for the removal of Harmonic Balancer Bolts and was used to untighten the test bolts after they had been secured into the test block.

The sockets tested and were of various weights, dimensions and configurations. Socket No. 1 weighted 8 ounces and is typical of a standard 19 MM impact socket. Socket No. 2 was manufactured for test purposes and weighed 20 ounces. Socket No. 3 is a high mass socket with a weight of 30 ounces and dimensions set forth in Table 2.

Figure 5:
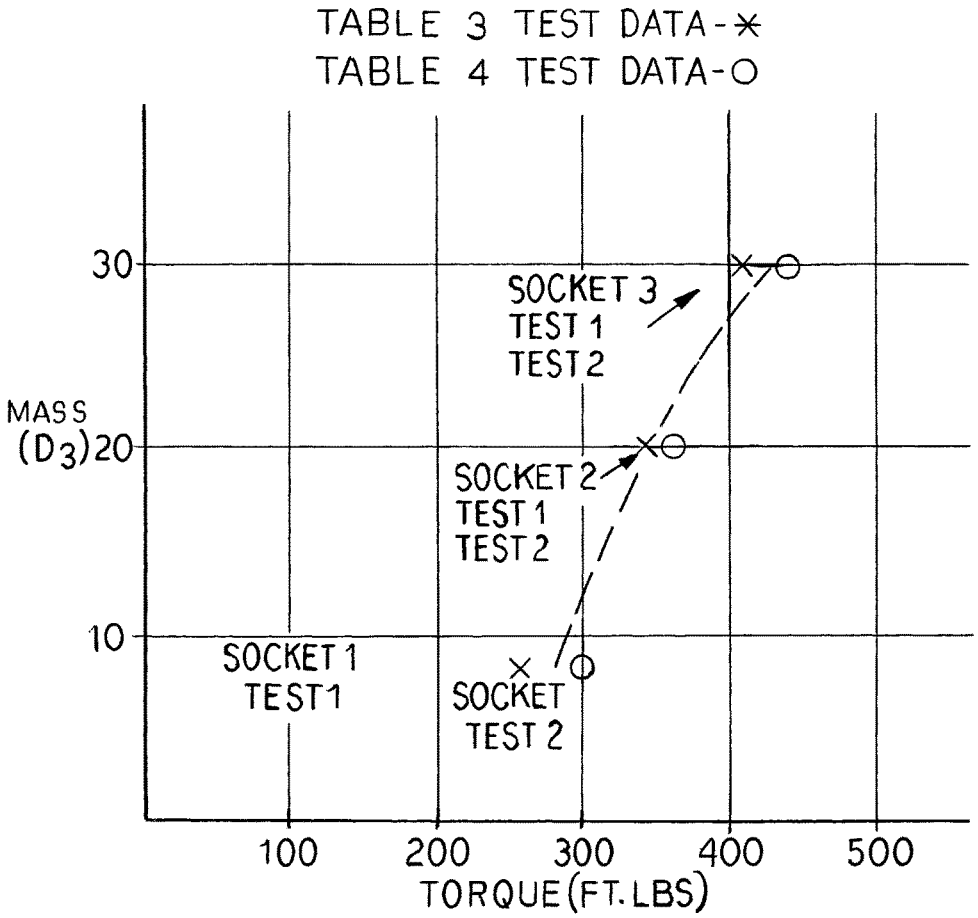
FIG. 5 is a graph depicting the relationship of the effectiveness of sockets in accord with the prior art relative to sockets in accord with the invention.

The test result (Tables 3 and 4) were compiled and demonstrate the effectiveness of the increased mass and test design of test sockets to loosen fasteners that had been tightened in increments up to 400 ft.-lbs. This information is exhibited in graphical form in FIG. 5. The mass and associated design of each socket is plotted with respect to the resultant torque necessary to remove the fastener. Increased mass incorporated into socket of varied length and other dimensions result in a non-linear, geometric enhancement in efficiency of fastener removal by means of a standard impact wrench with socket number 3 being the most efficient and enabling removal of the fasteners requiring the greatest force or torque to effect removal. As depicted in FIG. 5, the correlation between torque associated with the tool and mass indicates that the combination of the physical parameters as described result in a ratio of at least about 17.5 or more torque in foot pounds to tool mass in ounces is desired as a result of impact by means of an impact wrench such as described to achieve and enable desired efficiency of the tool.

Another approach to identify the improved torque that is applied to a fastener which has been locked in place constitutes calculation of a parameter wherein the relative mass of the prior art type socket is compared with examples of the sockets of the invention. Reference is therefore made to Table 5 which identifies various sized sockets. The column identified as Socket Style references standard prior art sockets. The legend "extended" references sockets designed and made in accord with the invention wherein the density of the socket material is the same for the standard as well as the extended sockets. In every event the comparison is made between socket sizes of the same size. The standard socket sizes are in conformance standards ASME B107, 110 ZR sockets. The sockets identified as extended are designed to engage fasteners of the same size but the ratio of the mass for the 19 MM sockets is approximately 2.25 to 1. For the 21 MM sockets, it is approximately 2.5 to 1 and for the 27 MM sockets, it is approximately 2 to 1. This variance provides significant advantages as indicated by the tensile forces that can be applied successfully to test specimens.

That is, test specimens were prepared substantially identically with utilization of a tension calibrator. The calibrator is a device typically used for calibrating impact wrenches and testing fasteners. The calibrator consists of a hydraulic load cell with an opening in the center for insertion of a sample bolt as a test specimen. As the bolt is tightened, the load cell is compressed creating internal pressure. A gauge measures the pressure and provides a dial readout allowing the tensile force created in the bolt to be measured. The test bolts for the variously sized specimens are listed in Table 5. All the bolts were identical material and had the same thread size. The bolts were provided with a hexagonal head that was the size corresponding to the socket that was being tested. The bolts were tightened in 1,000 pound tension increments.

After tightening, attempts were made to loosen the bolts using an impact wrench as described above. The impact wrench was assembled with the appropriate socket size. When the bolt could no longer be loosened with the selected socket, that tension limit was noted in the chart. The static pressure used for the impact wrench was 85 psi and the dynamic pressure was 55 psi in all events. As will be seen in Table 5, the tensile force applied to the test specimens wherein the specimen was subject to being removed by "extended" sockets was significantly greater than use of standard sockets. The ratio of the standard versus the "extended" sockets test results is approximated in the far right hand column. It is noted that the sockets incorporating design aspects of the present invention remove fasteners by imparting a tensile force typically greater than twice that of the standard sockets.

Thus, the construction of the sockets disclosed enable maximization of torque in a restricted space environment using standard torque wrenches. By correlating a set of sockets to the dimensional patterns and proportions of the example fasteners disclosed utilizing the diameter of the fastener associated with the socket, a uniquely configured, sized and "extended" mass socket can be constructed for efficient removal or driving of the particular sized fastener.

TABLE 3

| No. 1 Socket | | No. 2 Socket | | No. 3 Socket | |
|---|---|---|---|---|---|
| TORQUE (FT.-LBS.) REQ'D TO LOOSEN BOLT | PASS/ FAIL | TORQUE (FT.-LBS.) REQ'D TO LOOSEN BOLT | PASS/ FAIL | TORQUE (FT.-LBS.) REQ'D TO LOOSEN BOLT | PASS/ FAIL |
| 200 | Pass | 200 | Pass | 200 | Pass |
| 220 | Pass | 220 | Pass | 220 | Pass |
| 250 | Pass | 250 | Pass | 250 | Pass |
| 270 | Fail | 270 | Pass | 270 | Pass |
| 300 | Fail | 300 | Pass | 300 | Pass |
| 320 | Fail | 320 | Pass | 320 | Pass |
| 350 | Fail | 350 | Pass | 350 | Pass |
| 380 | Fail | 380 | Fail | 380 | Pass |
| 400 | Fail | 400 | Fail | 400 | Pass |

TABLE 4

| No. 1 Socket | | No. 2 Socket | | No. 3 Socket | |
|---|---|---|---|---|---|
| TORQUE (FT.-LBS.) REQ'D TO LOOSEN BOLT | PASS/ FAIL | TORQUE (FT.-LBS.) REQ'D TO LOOSEN BOLT | PASS/ FAIL | TORQUE (FT.-LBS.) REQ'D TO LOOSEN BOLT | PASS/ FAIL |
| 200 | Pass | 200 | Pass | 200 | Pass |
| 220 | Pass | 220 | Pass | 220 | Pass |
| 250 | Pass | 250 | Pass | 250 | Pass |
| 270 | Pass | 270 | Pass | 270 | Pass |
| 300 | Pass | 300 | Pass | 300 | Pass |
| 320 | Fail | 320 | Pass | 320 | Pass |
| 350 | Fail | 350 | Pass | 350 | Pass |
| 380 | Fail | 380 | Fail | 380 | Pass |
| 400 | Fail | 400 | Fail | 400 | Pass |

TABLE 5

SOCKET TEST RESULTS

| SOCKET SIZE | SOCKET STYLE | SOCKET WEIGHT (OZ.) | TENSILE FORCE (LBS.) APPLIED TO TEST SPECIMEN | ABLE TO LOOSEN TEST SPECIMEN | MASS RATIO |
|---|---|---|---|---|---|
| 19 MM | STANDARD | 8 | 19,000 | Yes | 1.5 to 1 |
| 19 MM | STANDARD | 8 | 20,000 | No | 1.5 to 1 |
| 19 MM | EXTENDED | 30 | 29,000 | Yes | 1.5 to 1 |
| 19 MM | EXTENDED | 30 | 30,000 | No | 1.5 to 1 |
| 21 MM | STANDARD | 9.1 | 16,000 | Yes | 1.9 to 1 |
| 21 MM | STANDARD | 9.1 | 17,000 | No | 1.9 to 1 |
| 21 MM | EXTENDED | 29 | 30,000 | Yes | 1.9 to 1 |
| 21 MM | EXTENDED | 29 | 31,000 | No | 1.9 to 1 |
| 27 MM | STANDARD | 15 | 20,000 | Yes | 1.5 to 1 |
| 27 MM | STANDARD | 15 | 21,000 | No | 1.5 to 1 |
| 27 MM | EXTENDED | 31 | 30,000 | Yes | 1.5 to 1 |
| 27 MM | EXTENDED | 31 | 31,000 | No | 1.5 to 1 |

The above test results demonstrate the effectiveness of the additional mass and alternate design via extended sockets to loosen the tightened test specimens. This would equate to the enhanced effectiveness for loosening various bolts, fasteners, etc. that may be corroded or damaged.

Variable features of the "extended" sockets invention thus include: (1) The socket typically includes a uniform cross section of a regular geometric configuration, preferably a circle, or a multi sided polygon with equal length sides. (2) The density of the socket material may vary axially within recommended limits. (3) The configuration may vary axially. (4) The moment of inertia of the socket subjected to the torque of an impact wrench is in the range of 1 to about 6 times the moment of inertia of the impact wrench. (5) The length verses the nominal diameter of the socket is in the range 1:1 to 6:1. A preferred range is about 2:1 to 4:1. (6) The mass of the socket is in the range of 2 to 3 times of the mass of corresponding standard ASMEB107, 110 ZR sockets (7). The correlation between thread surface engagement (and size) and fastener mass is generally proportional to socket mass (8). The correlation between the torque imparted by an impact wrench and the torque generated thereby to socket tools is facilitated by the mass and geometric design of the "extended" socket tool as demonstrated by the data displayed in FIG. 5, and a cylindrical cross section is favored to most effectively size the socket for its design purpose. Thus, empirical data provides correlation information such as the reported empirical test results.

While there has been set forth embodiments of the invention it is to be understood that the invention is to be limited only by the following claims and equivalents thereof.

What is claimed is:

1. A harmonic balancer fastener removal socket tool for use in combination with an impact tool, said tool having a drive, said socket comprising:

a generally uniform, cylindrical socket body, a driven end, a drive end, a straight centerline axis extending between said ends, a cross section counterbore compatible with a said tool drive at the driven end, a counterbore at the drive end, a first planar face at the driven end transverse to the axis, a second planar face at the drive end transverse to the axis and parallel to the first face, said body having a first generally axially symmetric uniform outside cylinder diameter section extending axially from the second face toward the first face in the range of about 85%±4% of the axial distance from the second face to the first face, said body further including a second generally axially symmetric, uniform outside cylinder lesser diameter section extending axially intermediate said first section and said first face, said second outside cylinder diameter section in the range of about 80%±5% of the first outside cylinder diameter of said first section, said outside radius of said first section in the range of 2.25±0.2 times point to point dimension of a side of said hexagonal counterbore, said socket driven end counterbore having an axial depth dimension in the range about 2±0.2−0.1 times the axial depth dimension of said hexagonal counterbore, said socket have a material density in the range about 0.28±0.3 pounds per cubic inch and a tensile strength in a range greater than about 150,000±25,000 pounds/in2 and a toughness in the range of about 28 to 60 HRC.

2. A socket as set forth in claim 1 wherein the driven end counterbore has a point to point diameter about 1.0±0.15 inches.

3. The tool of claim 1 wherein the tool has a mass ratio greater than about 2.0 relative to ASME B107.110-2012 sockets.

4. A harmonic balancer removal socket tool for use in combination with an impact tool including an impact drive, said socket comprising:

a generally uniform cross section body member having a longitudinal axis, a driven end with an axially transverse first planar surface with a first coaxial counterbore opening in said first planar surface, said first coaxial opening compatible with an impact tool;

said body further including a drive end axially spaced from said driven end, said drive end including a second axially, transverse planar surface with a second coaxial counterbore in said second planar surface;

said body having a generally regular geometric transverse cross section configuration, a first body section having an axial dimension L1 greater than a lesser axial dimension L2, and an arcuate, uniform radius transition body section connecting the lesser body section to the greater body section, said body having a generally uniform material density and a maximum cross section width W, defining a mass in the range of 15 to 40 ounces and a moment of inertia equal to 1 to 6 times a moment of inertia of an impact wrench compatible with said impact wrenches.

5. The tool of claim 4 wherein the tool has a moment of inertia in the range of about 1 to 6 times the moment of inertia of an impact wrench.

6. The tool of claim 4 wherein the tool has a mass ratio greater than about 2.0 relative to ASME B107.110-2012 sockets.

7. A harmonic balancer fastener removal socket tool for use in combination with an impact tool, said impact tool having a drive, said socket tool comprising:

a generally circular cross section socket body, said socket body including a driven end having a second diameter, a drive end having a first diameter, a straight centerline axis extending between said socket body driven end and said socket body drive end, a cross section counterbore in said socket body driven end compatible with a said impact tool drive at the driven end, a counterbore in said socket body at the drive end, a first circular planar face at the driven end transverse to the axis, a second circular planar face at the drive end transverse to the axis and parallel to the first face, said socket body having a first axially symmetric outside diameter section extending axially from the first face toward the second face, said socket body further having a second generally axially symmetric, outside diameter section extending axially from the second face toward the first face;

said first outside diameter having a ratio to the second outside diameter in the range of about 1.70±0.10 to 1.375±0.30, said socket driven end counterbore having an axial depth dimension in the range about 2±0.2−0.1 times the axial depth dimension of said socket drive end counterbore, said socket body having a material density in the range about 0.28±0.3 pounds per cubic inch and a tensile strength in a range greater than about 150,000±25,000 pounds/square inch and a toughness in the range of about 28 to 60 HRC.

8. A socket tool as set forth in claim 7 wherein the socket body driven end counterbore has a point to point diameter no greater than about 1.0 inches.

9. A harmonic balancer removal socket tool for use in combination with an impact tool, said impact tool including an impact drive, said socket tool comprising:

A socket body including a socket body drive end axially spaced from a socket body driven end, said socket body drive end including a first axially, transverse planar surface with a first coaxial counterbore in said first planar surface;

said socket body further including a generally uniform cross section, first body section having a longitudinal axis, a socket body driven end with an axially transverse second planar surface with a second coaxial counterbore opening in said second planar surface, said second coaxial counterbore compatible with a said impact tool;

said socket body having a generally regular circular transverse cross section configuration;

said body having a generally uniform material density and a maximum cross section width W, defining a mass in the range of 15 to 40 ounces and a moment of inertia equal to 1 to about 6 times a moment of inertia of a said impact wrench compatible with said socket tool;

said first planar surface having a diameter in the range of 1.375±0.30 inches and said second planar surface having a diameter in the range of 1.70±0.10 inches; and a mass ratio greater than about 2.0 relative to ASME B107.110-2012 sockets.

* * * * *